US011767970B2

(12) United States Patent
McDonald et al.

(10) Patent No.: US 11,767,970 B2
(45) Date of Patent: Sep. 26, 2023

(54) EASY MOUNT LIGHTING FIXTURE AND ELECTRICAL RECEPTACLE SYSTEM

(71) Applicant: J & J Properties of Cortland, LLC, Cortland, OH (US)

(72) Inventors: John McDonald, Cortland, OH (US); Joseph Driscoll, Warren, OH (US)

( * ) Notice: Subject to any disclaimer, the term of this patent is extended or adjusted under 35 U.S.C. 154(b) by 78 days.

(21) Appl. No.: 17/391,547

(22) Filed: Aug. 2, 2021

(65) Prior Publication Data

US 2022/0268425 A1 Aug. 25, 2022

Related U.S. Application Data

(63) Continuation-in-part of application No. 17/179,732, filed on Feb. 19, 2021, now Pat. No. 11,381,029.

(51) Int. Cl.

| | |
|---|---|
| ***H01R 33/94*** | (2006.01) |
| ***F21V 21/002*** | (2006.01) |
| ***F21V 23/06*** | (2006.01) |
| ***H01R 13/639*** | (2006.01) |
| ***F21V 23/00*** | (2015.01) |
| *F21Y 115/10* | (2016.01) |

(52) U.S. Cl.

CPC ..... *F21V 21/002* (2013.01); *F21V 23/003* (2013.01); *F21V 23/06* (2013.01); *H01R 13/6395* (2013.01); *H01R 33/94* (2013.01); *F21Y 2115/10* (2016.08)

(58) Field of Classification Search

CPC .. H01R 13/447; H01R 13/6395; H01R 27/02; H01R 13/5213; H01R 13/73; H01R 24/20; H01R 13/72; H01R 24/76; H01R 13/7175

See application file for complete search history.

(56) References Cited

U.S. PATENT DOCUMENTS

| | | | | |
|---|---|---|---|---|
| 1,595,972 A | | 8/1926 | Reamer | |
| 1,614,163 A | | 1/1927 | Van Amberg | |
| 1,629,568 A | | 5/1927 | Benjamin | |
| 4,725,245 A | * | 2/1988 | Shea | H01R 13/44 439/332 |
| 4,857,004 A | * | 8/1989 | Poirier | H01R 13/447 174/67 |
| 5,165,042 A | * | 11/1992 | Klinger | H01R 13/447 174/67 |
| 5,539,821 A | * | 7/1996 | Blonder | H02J 7/0044 379/454 |
| 5,708,705 A | * | 1/1998 | Yamashita | H04M 1/725 379/454 |
| 6,341,981 B1 | * | 1/2002 | Gorman | H01R 24/78 174/53 |
| 6,362,987 B1 | * | 3/2002 | Yurek | H01R 29/00 363/146 |
| 6,372,987 B1 | * | 4/2002 | Ha | H02G 3/14 174/67 |

(Continued)

*Primary Examiner* — Truc T Nguyen

(74) *Attorney, Agent, or Firm* — Harpman & Harpman

(57) ABSTRACT

An electrical and receptacle and fixture system that provides a simple, safe and quick mechanical electrical connection for mounting electrical fixtures to a receptacle box and connecting electrical equipment. The connection system has dedicated fixture and receptacle as well as conversion adapters for existing electrical connections. An LED integral light and switch assembly is adaptable to connect system providing self-contained point of use switchable LED lighting as required.

9 Claims, 7 Drawing Sheets

(56) References Cited

U.S. PATENT DOCUMENTS

| | | | | |
|---|---|---|---|---|
| 6,518,724 | B2 * | 2/2003 | Janik | H02J 7/0044 320/115 |
| 6,805,469 | B1 * | 10/2004 | Barton | H02J 9/02 362/802 |
| 6,993,289 | B2 * | 1/2006 | Janik | H04B 3/54 375/259 |
| 7,229,322 | B2 * | 6/2007 | Bangert | H01R 25/003 439/652 |
| 7,756,268 | B2 * | 7/2010 | Hazani | H01R 13/719 379/413.04 |
| 8,378,625 | B2 * | 2/2013 | Gourley | H04M 1/04 248/176.1 |
| 8,616,904 | B1 * | 12/2013 | Martin | H01R 13/4534 439/188 |
| 11,201,002 | B2 * | 12/2021 | Ware | H01B 9/003 |
| D942,923 | S * | 2/2022 | Becker | D12/400 |
| 11,489,280 | B1 * | 11/2022 | Baldwin | H01R 24/76 |
| 2006/0209531 | A1 * | 9/2006 | Tiesler | B60R 16/03 362/183 |
| 2008/0190640 | A1 * | 8/2008 | Gorman | H01H 11/0006 174/53 |
| 2010/0246232 | A1 * | 9/2010 | Chen | H01R 31/065 363/146 |
| 2017/0187138 | A1 * | 6/2017 | Lin | H01R 13/4534 |
| 2017/0222364 | A1 * | 8/2017 | Smith | H05B 47/11 |
| 2017/0356638 | A1 * | 12/2017 | Mousavi | F21S 8/035 |
| 2022/0158432 | A1 * | 5/2022 | Armstrong | H02G 3/16 |

* cited by examiner

EASY MOUNT LIGHTING FIXTURE AND ELECTRICAL RECEPTACLE SYSTEM

This is a Continuation in Part application of Ser. No. 17/179,732, filed Feb. 19, 2021.

BACKGROUND OF THE INVENTION

1. Technical Field

This invention relates to electrical fixtures such as lighting and electrical receptacles required to connect electrical power devices to a source of electricity in a residential or commercial application.

2. Description of Prior Art

Prior art devices of this type can be seen in adapted plug-in light fixtures, for example, see U.S. Pat. Nos. 1,614,163, 1,629,568 and 1,595,972.

Standard power outlet receptacles as having a plug-in configuration where a wall receptacle has multiple plug receiving apertures, each corresponding to a hot "positive" and correspondingly "negative" common side of an electrical circuit with an independent ground.

SUMMARY OF THE INVENTION

An electrical receptacle and mounting fixture system for electrical connections of fixed fixtures and receptacle plugs adapted for electrical equipment and the like. The connector system uses a power distribution connector block with opposing positive and neutral contact surfaces thereon. An integrated safety and support cover defines fixture and plug engagement release orientation for connective support with resilient use activation release lock in plug adapted configurations.

DETAILED DESCRIPTION OF THE INVENTION

Figure 1:
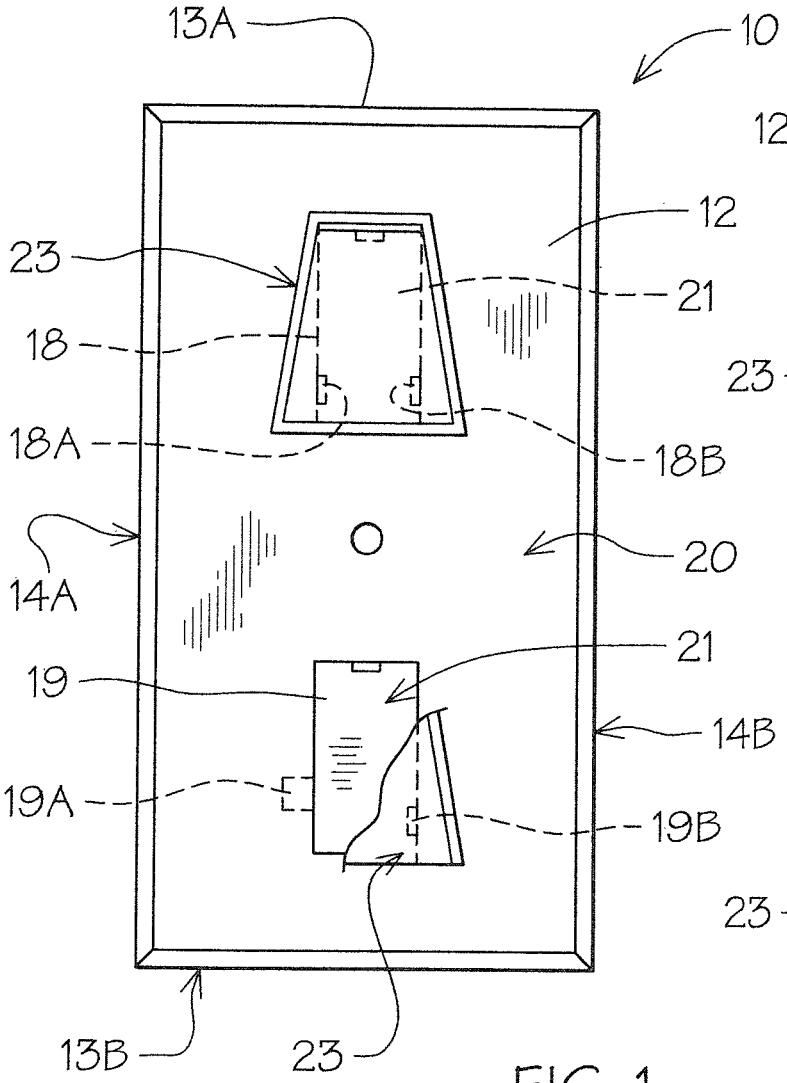
FIG. 1 is a front elevational view of the receptacle plug adapter of the invention.
Figure 2:
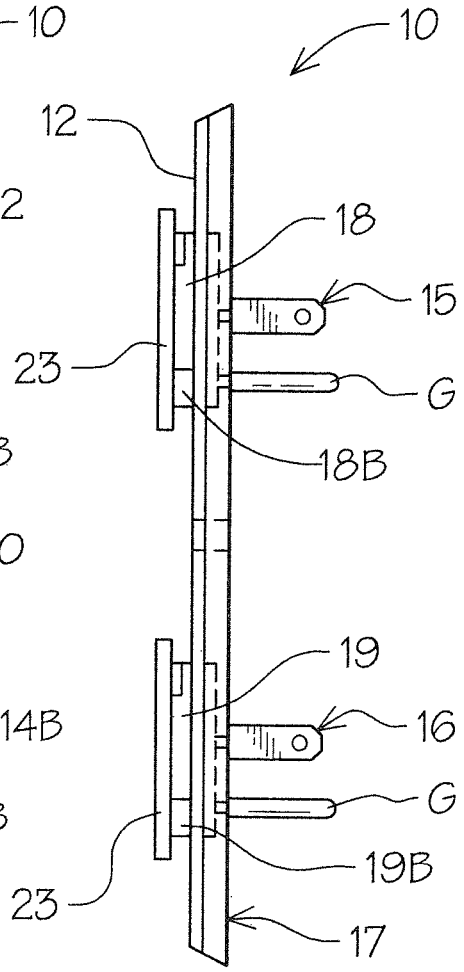
FIG. 2 is a side elevational view thereof.
Figure 3:
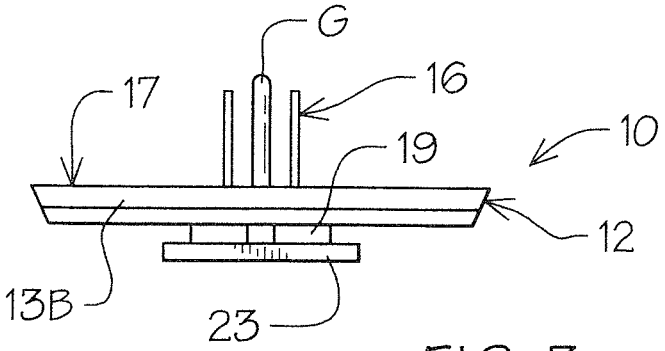
FIG. 3 is a bottom plan view thereof.

Referring to FIGS. 1-3 of the drawings, a primary electrical receptacle adapter fitting 10 can be seen having a main support body 12 with equilateral top surfaces 13A, bottom surfaces 13B and respective spaced parallel side surfaces 14A and 14B. In this example chosen for illustration, a pair of spaced standard electrical plugs 15 and 16 found in the majority of domestic electrical supply systems extend from a rear surface 17 of the body member 12. The plugs 15 and 16 are adaptable for engagement into a power wall receptacle, not shown, as is well understood and common within the art.

The standard electrical plugs 15 and 16 have a hot H and neutral N prongs and in this example a ground plug G.

Each of the electrical plugs 15 and 16 are in electrical communication with respective power transfer blocks 18 and 19 of the invention on the front surface 20 of the body member 12. Each of the power transfer blocks 18 and 19 are of a raised rectangular configuration having a flat front surface 21 with electrically conductive metal side surface strips 18A and 18B and 19A and 19B respectively which are preferably made of brass and are in direct electrical contact with their corresponding electrical plug assemblies 15 and 16.

Each of the respective raised power transfer blocks 18 and 19 have an overlapping cover 23 thereon which is of a foreshortened flat triangular configuration, best seen in FIG. 1 of the drawings.

Figure 4:
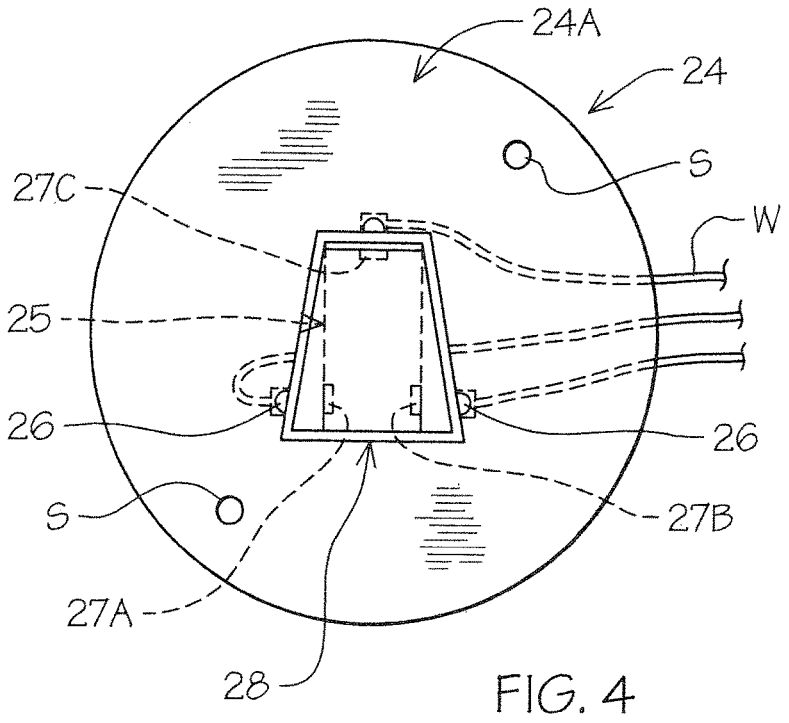
FIG. 4 is a front elevational view of a work box plate showing the fixture mounting and connection elements of the system.
Figure 5:
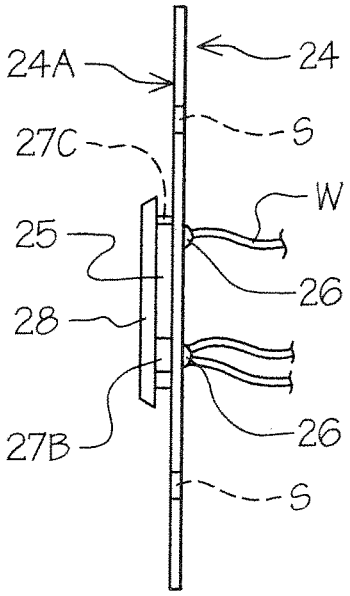
FIG. 5 is a side elevational view thereof.

Referring now to FIGS. 4 and 5 of the drawings, a surface electrical fixture mounting adapter plate 24 of the invention can be seen for use with an existing in the wall junction mounting box, not shown.

The fixture mounting adapter plate 24 has, in this example, a circular configuration but could be of any shape, such as square, not shown, which will match the appropriate mounting box so used.

The adapter plate 24 has a flat annular surface 24A with a pair of screw holes S for attaching to an existing wall box. A central raised upstanding power transfer block 25 is provided that extends from the front plate surface 24A and has a pair of electrical and attachment connectors 26 securing it to the plate and providing attachment screws for connecting to power wires in the mounting box, in this example, as will be well understood by those skilled in the art.

The power transfer block 25 is rectangular having a pair of power transfer strips 27A and 27B on respective spaced side surfaces thereof in communication with the afore referred to power connections 26. A ground wire connector 27C is positioned on the upper end surface of the power transfer block 25.

An overlapping safety and engagement support cover 28 identical to that described in the receptacle adapter fitting 10 is provided and is, as noted, of a foreshortened triangular shape.

Figure 6:
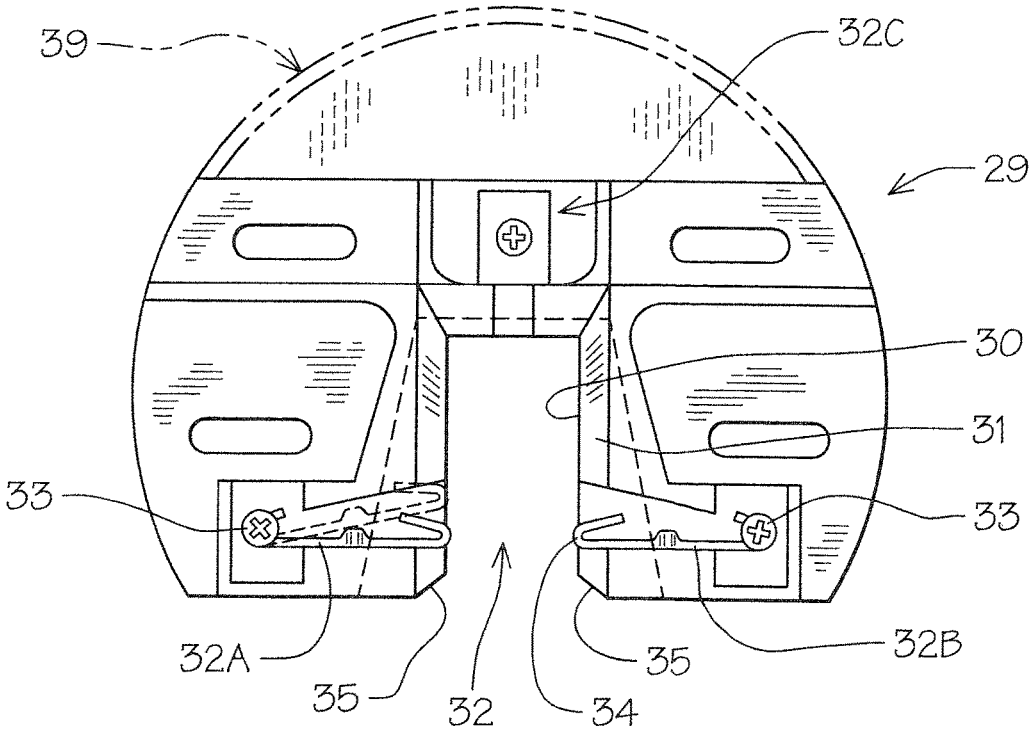
FIG. 6 is a partial rear elevational view of an electrical fixture example with interlocking mounting and release connector adapters of the system.

Referring now to FIG. 6 of the drawings, a universal fixture power connector and attachment support fitting 29 can be seen with a female fitting 30 that has a contoured recess 31 with an opening slot 32 and corresponding pair of resilient metal power contact wires 32A and 32B thereon, and a ground contact screw assembly 32C there between.

Figure 7:
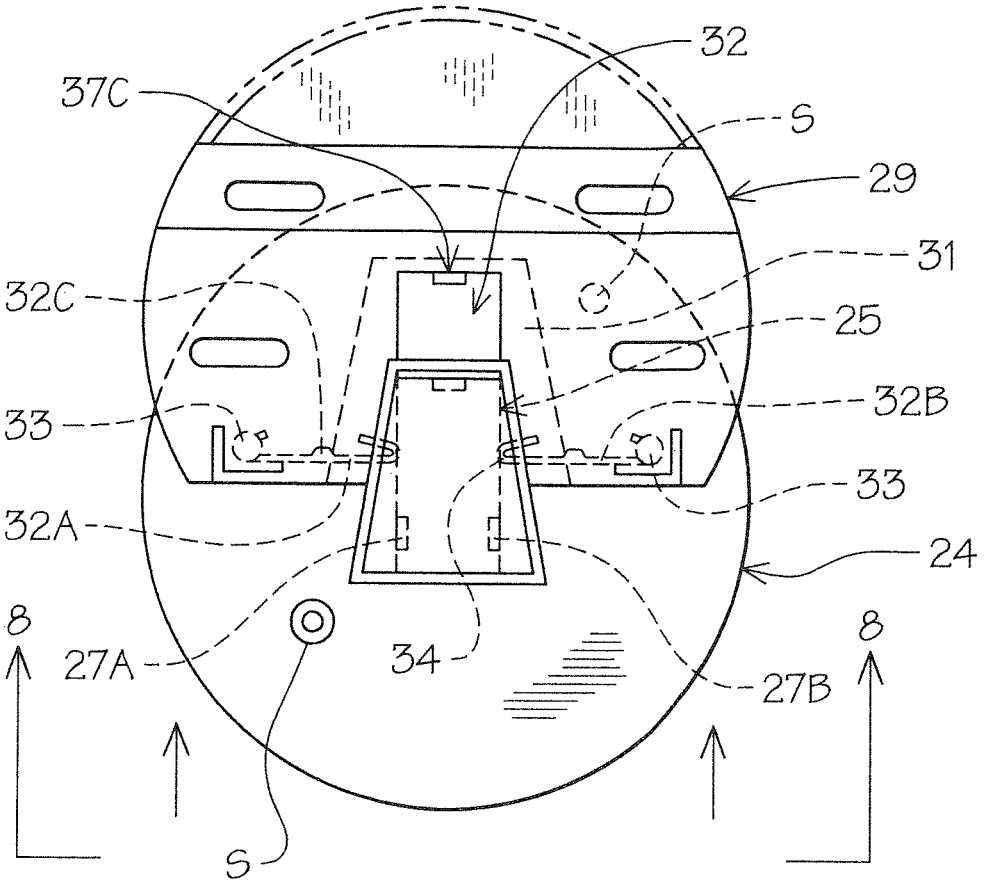
FIG. 7 is a front elevation composite view of the electrical fixture adaptor engaging the adaptor plate.

The power contact wires 32A and 32B extend from and are secured by power connector screws 33 respectively in each of the wires 32A and 32B have a return free end bent at 34 that extends marginally into the defined opening 32 for selective resilient engagement with the hereinbefore described power transfer strips 27A and 27B on the power transfer block 25 when slidably engaged therein as illustrated in FIG. 7 of the drawings. Each of the contact wires 32A and 32B have an area of reduced axial dimension at 32C to act as a fusable link that will provide circuit protection under high electrical load induced by a short, for example, as known in the art.

Figure 8:
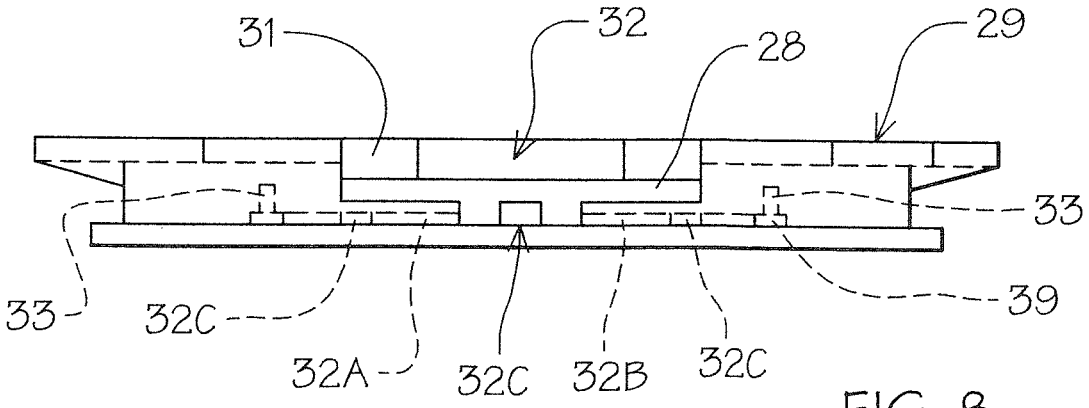
FIG. 8 is an enlarged bottom elevational view on lines 8-8 of FIG. 7.

It will be seen that the contoured recess 31 conforms to the tapered sides of the overlapping safety and engagement support cover 28 so as to provide an interlocking interface frictional fit there between as it progresses in engagement indicated by directional arrows in FIG. 7 and in broken lines in FIG. 8 of drawings. The opening 32 has a tapered base 35 to afford ease of alignment mount for receiving the power transfer block 25 on the electrical receptor adapter fitting 10. The interlocking fixture fitting will provide a one-step power connection and fixture support accordingly.

Figure 9:
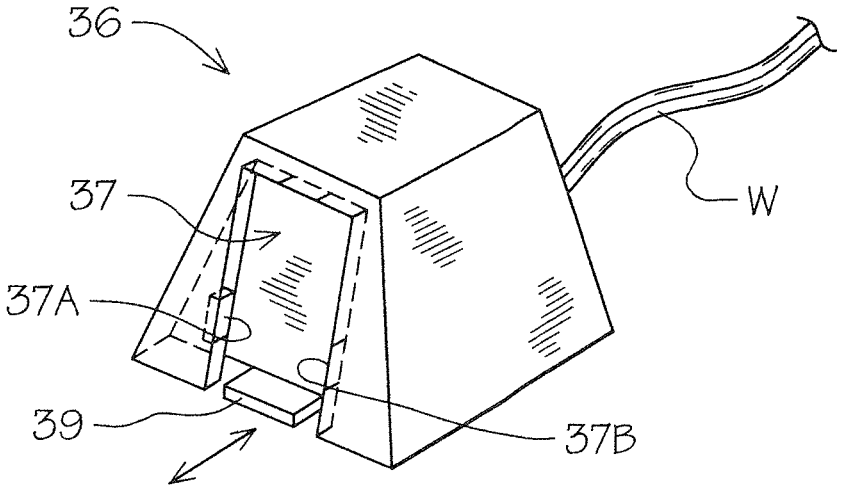
FIG. 9 is a perspective view of an electrical adapter plug of the system.
Figure 10:
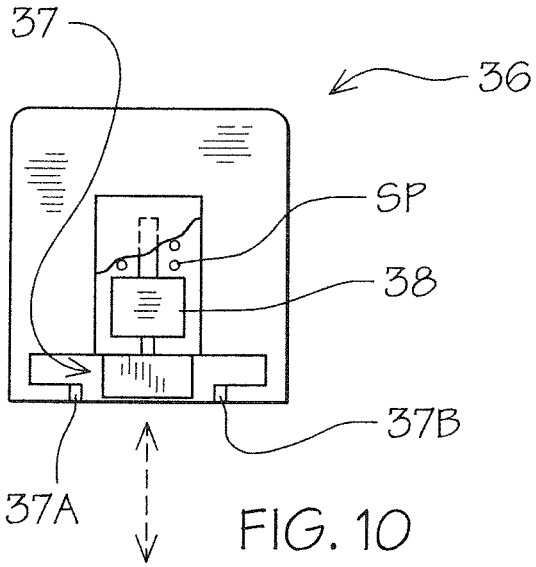
FIG. 10 is a bottom plan view thereof.
Figure 11:
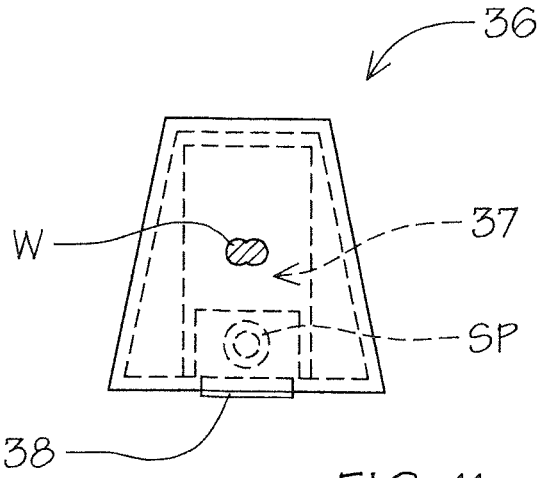
FIG. 11 is a partial front elevational view of an electrical adapter plug engaged on a receptacle with portions in broken and solid lines.

Referring to FIGS. 9, 10 and 11 of the drawings, a plug 36 of the invention can be seen having an electrical cord W end fitting with a female receiving opening 37 within and oppositely disposed electrical contact metal strips 37A and 37B.

A spring S urged retainment lock element button 38 is used to retract a resiliently advanced retainment element 39 on the bottom of the plug 36 so as to engage and hold the plug-in locked position once slidably engaged over the receptacle adapter fitting 10 as seen in FIGS. 1 and 3 of the drawings.

It will be seen that the plug 36 has the foreshortened triangular receiving opening slot at 37 into which the receptacle cover 28 is received allowing the power transfer block 25 to be slidably received therein and connect with the plug's contact metal strips 40A and 40B transferring power thereto and locking the plug-in place.

To remove the plug 36, the lock button 38 is user engaged releasing the plug 36 allowing it to slide up and off the receptacle, in this example.

Referring to FIGS. 6 and 7 of the drawings, a modified support fitting outdoor extension is illustrated of a hood element 39 shown in broken lines which will allow for use outdoors as so illustrated.

Figure 12:
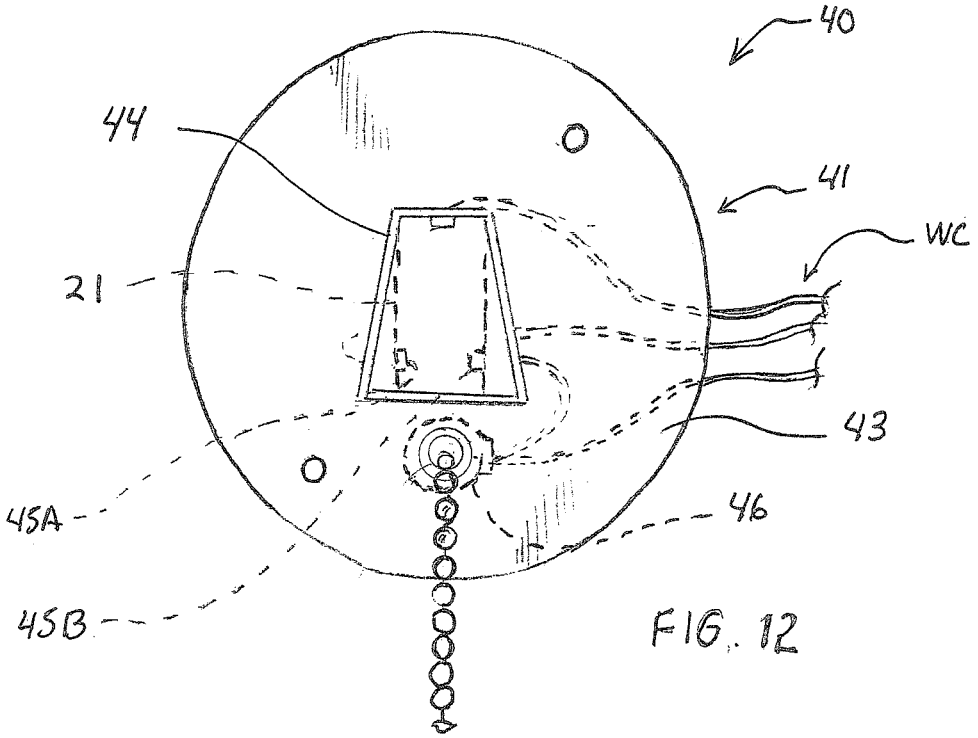
FIG. 12 is a front elevational view of an alternate switched work box mounting plate showing connector elements and switch.
Figure 13:
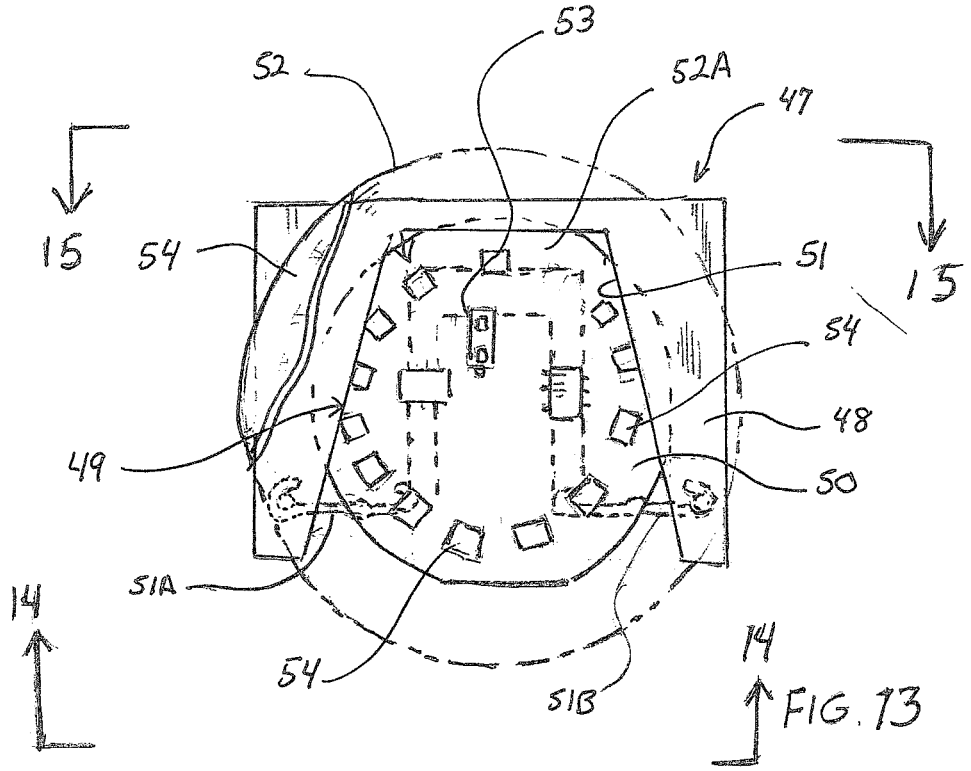
FIG. 13 is a front elevational composite view of an alternate switched LED light adaptive fixture mounting plate assembly.
Figure 14:
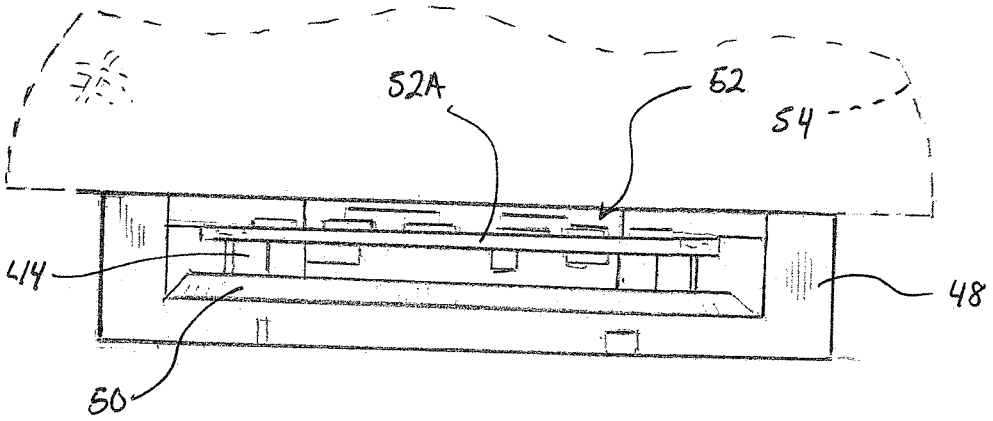
FIG. 14 is an enlarged bottom elevational view on lines 14-14 of FIG. 13 of the alternate switch LED light adaptive fixture with portions in broken lines.
Figure 15:
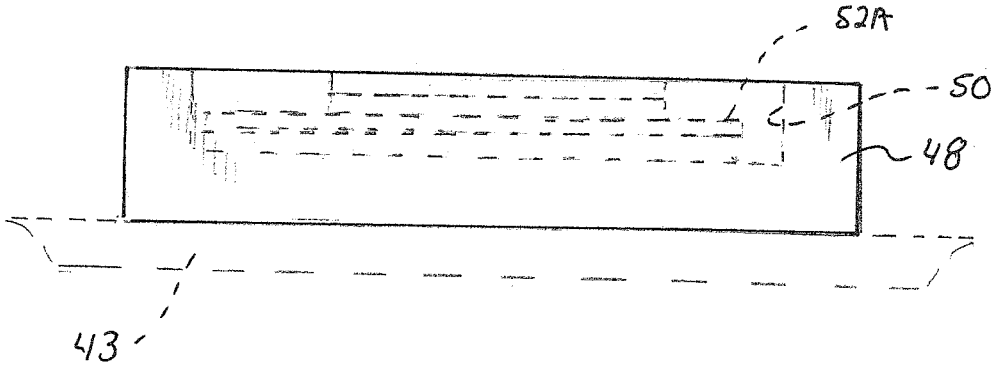
FIG. 15 is an enlarged top elevational view on lines 15-15 of FIG. 13 thereof.

Referring now to FIGS. 12-14 of the drawings, an alternate switched LED adaptive fixture mounting 40 can be seen having a switch mounting plate assembly 41 with an apertured switch plate 43 having upstanding switch power transfer block 44 similar to the hereinbefore described power transfer blocks 18 and 19 in the preferred form of the invention.

Power transfer block 44 has corresponding power transfer strips 45A and 45B within and a ground contact there between.

A manual power pull switch 46 is mounted on the switch mounting plate 43 in spaced relation to the power block 42 and is in electrical communication with the electric wiring circuit WC.

The pull switch 46 therefore enables selective power supply control to the power transfer block 44 as will be described in greater detail hereinafter and as best seen in FIG. 12 of the drawings.

Referring now to FIG. 13 of the drawings, an LED light fixture mount 47 can be seen having a support base 48 and a registration female fitting 49 defined within by a contoured recess 50 having a mounting and power transfer fitting slot 51. It will be seen that a pair of oppositely disposed resilient metal power contact wires 51A and 51B are positioned within the mounting slot 50 providing selective power transfer engagement with the corresponding power strips 43A and 43B within the designated engagement power transfer block 44 as previously described and so engaged.

An LED light assembly 52 is secured within the slot fitting 51 having, in this example, an annular circuit board 52A with LED power drivers 53 and a plurality of LEDs 54 positioned annularly there about for a self-contained light generating panel as is well known in the art.

It will be evident that given the hereinbefore description for the light fixture registration and mounting fitting 40 that the LED light assembly will be powered upon registration engagement on the respective power block 44 and its integral pole switch 46 in the mounting switch plate 43 as hereinbefore described.

A light diffuser and protection globe 54 is mounted over the LED light assembly providing uniform light distribution as well as protecting the LED light panel and mounting assembly as best illustrated partially in FIG. 13 of the drawings.

Figure 16:
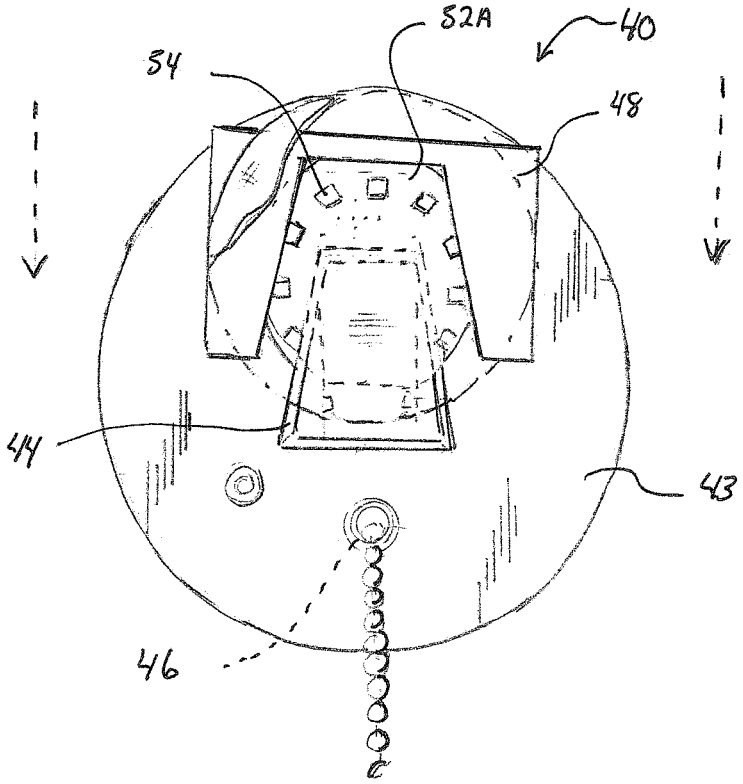
FIG. 16 is a front elevation composite view of the LED light adaptive fixture adaptor engaging the switch adaptor plate.

Referring now to FIG. 16 of the drawings, the LED light adaptive fixture mounting can be seen illustrating the orientation and mounting of the LED panel within the support base 48 allowing for registration over the power block 44 and the switch plate 43 as hereinbefore described.

It will be evident that the LED lighting assembly can therefore be installed at any located power block 44, as needed, due to its simplicity and ease of mounting and removal afforded by the easy mount lighting fixture of the disclosed power receptacle and lighting system of the invention.

It will thus be seen that a new and novel electrical receptacle and fixture system has been illustrated and described that provides a simple one step fixture and support engagement and electrical connection through the use of a unique power transfer block and integrated safety cover support element unique and novel within the industry.

It will therefore be evident that various changes and modifications may be made thereto without departing from the spirit of the invention. Therefore,

We claim:

1. A power receptacle and fixture engagement system comprising, an adapter fitting and an universal fixture power connector slidably engaged therein, said adapter fitting having an upstanding power transfer block with oppositely disposed power contact strips and a ground connector thereon, a cover overlapping said power transfer block, said universal fixture power connector having a female fitting with resilient power contact wires and a fixed ground contact connector there between.

2. The power receptacle and fixture engagement system set forth in claim 1 wherein said cover overlapping said power transfer block defines a pair of parallel spaced receiving retainment channels for said universal fixture power connector.

3. The power receptacle and fixture engagement system set forth in claim 1 wherein said resilient power contact wires are selectively engaged by a respective power contact strips upon full engagement of said universal fixture power connector and said adapter fitting to one another.

4. The power receptacle and fixture engagement system set forth in claim 3 wherein said resilient power contact wires have power connector screws in connection with a source of power.

5. The power receptacle and fixture engagement system set forth in claim 1 further comprises a remote fixture plug having a plug body, a pair of power wires extending from said body, a female receiving opening, power contact strips within said opening in communication with said power wires and a source of power, a resilient retainment element for selective engagement with said power plate adapter upon engagement therein.

6. A power receptacle and light fixture engagement system comprising, an adapter fitting and an independent LED light assembly fixture slidably engaged therein, said plate adapter fitting having an upstanding power transfer block with oppositely disposed power transfer contact strips and a ground connector therein, a cover overlapping said power transfer block, said LED light assembly fixture comprising, female fitting with a resilient power contact wires and a fixed ground contact there between.

7. The power receptacle and light fixture engagement system set forth in claim 6 wherein said cover overlapping said power transfer block defines a pair of parallel spaced receiving retainment channels for registerable receiving said LED light fixture.

8. The power receptacle and LED light fixture engagement system set forth in claim 6 wherein said resilient power contact wires are selectively engaged by respective power contact strips upon full engagement of said LED light fixture and said power plate adaptor to one another.

9. The power receptacle and light fixture engagement system set forth in claim 6 wherein said LED light fixture further comprises, LED power drivers, a plurality of LEDs on a circuit board secured within said LED light assembly fixture.

* * * * *